US007810465B2

(12) United States Patent
Sato et al.

(10) Patent No.: US 7,810,465 B2
(45) Date of Patent: Oct. 12, 2010

(54) POWER-STORAGE-TYPE ENGINE STARTING SYSTEM

(75) Inventors: Yoshikazu Sato, Wako (JP); Hiroshi Moriyana, Wako (JP); Shingo Yoneda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 7 days.

(21) Appl. No.: 12/478,207

(22) Filed: Jun. 4, 2009

(65) Prior Publication Data

US 2009/0301425 A1 Dec. 10, 2009

(30) Foreign Application Priority Data

Jun. 4, 2008 (JP) ..... 2008-147088

(51) Int. Cl.
*F02N 1/00* (2006.01)
*F02N 3/02* (2006.01)

(52) U.S. Cl. ..... 123/185.3; 123/185.14

(58) Field of Classification Search ..... 123/185.1, 123/185.14, 185.15, 185.2, 185.3
See application file for complete search history.

(56) References Cited

U.S. PATENT DOCUMENTS 3,754,543 A 8/1973 Harkness
5,161,489 A 11/1992 Morooka
7,201,130 B2 * 4/2007 Hashiba ..... 123/185.14
7,343,891 B1 * 3/2008 Chang ..... 123/185.3
7,658,176 B2 * 2/2010 Fattorusso et al. ..... 123/185.3
2003/0015162 A1 1/2003 Harada et al.
2005/0211216 A1 * 9/2005 Otsuki ..... 123/185.3

FOREIGN PATENT DOCUMENTS

EP 1384881 A2 1/2004
JP 2004-263615 A 9/2004

OTHER PUBLICATIONS

European Search Report dated Aug. 10, 2009, issued in corresponding European Patent Application No. 09251486.8.

* cited by examiner

*Primary Examiner*—Hai H Huynh
(74) *Attorney, Agent, or Firm*—Westerman, Hattori, Daniels & Adrian, LLP

(57) ABSTRACT

A power-storage-type engine starting system includes a coil spring for storing power to be used in starting the engine. An end of a crankshaft is configured to pass through a cylindrical shaft part and is passed through a one-way clutch attached to inside of an assist boss so that an assist boss and the one-way clutch can be provided at radially outside of the shaft end, whereby the crankshaft is made shorter.

4 Claims, 8 Drawing Sheets

40
42
77
43
44
78
41
81
82
11
47
54
76
31
53
31a
52
55
51
46
85
84
48
41
75

POWER-STORAGE-TYPE ENGINE STARTING SYSTEM

FIELD OF THE INVENTION

The present invention relates to an improvement in a power-storage-type engine starting system that utilizes power stored in a spring to start a multi-purpose engine.

BACKGROUND OF THE INVENTION

Japanese Patent Application Laid-Open Publication No. 2004-263615 discloses a power-storage-type recoil starter. In the disclosed recoil starter, a reel support shaft attached to the fixed side of an engine via a main body casing is provided on the extension axis of a crankshaft, and a recoil pulley on which a recoil rope is wrapped is rotatably attached to the reel support shaft.

In the power-storage-type recoil starter described above, the main body casing is attached to the engine. The reel support shaft is attached to the center part of the main body casing so as to be positioned on the extension axis of the crankshaft. A rope reel is rotatably attached to the reel support shaft. The recoil rope is wrapped onto the rope reel. A handle is attached to the end of the recoil rope.

The rope reel is connected to a spring case via a speed reduction mechanism, and a cam wheel is connected to the spring case via a power storage mechanism. A rotating member is connected to the cam wheel via a transmission mechanism. The rotating member is attached to the crankshaft.

The transmission mechanism is provided between the cam wheel and the rotating member so that the rotation of the engine when the engine starts is not transmitted to the recoil starter. The transmission mechanism is composed of a plurality of cam claws formed on the external peripheral surface of the cam wheel, and a centrifugal ratchet provided to the rotating member so as to be engaged with the cam claws by centrifugal force.

However, in the conventional recoil starter, the centrifugal ratchet that constitutes the transmission mechanism is structured so as to separate from the cam claws by centrifugal force, and since the centrifugal ratchet is necessarily provided at the crankshaft and to the outside in the radial direction of the cam claws, a cylindrical rotating member must be attached to the crankshaft, and the cam wheel must be rotatably supported by the reel support shaft. Specifically, a pulley support shaft must be provided on the extension axis of the crankshaft, and the profile of an engine that includes the recoil starter is enlarged in the direction of the crankshaft.

SUMMARY OF THE INVENTION

An object of the present invention is to reduce the size of an engine that is provided with a power-storage-type recoil starter.

According to the present invention, there is provided a power-storage-type engine starting system which comprises: a power-storage-type recoil starter; a crankshaft rotatable by the recoil starter to start the engine; a recoil pulley rotatably supported by a pulley support shaft and having a recoil rope wrapped therearound; a wheel member adapted to be rotatably supported by the crankshaft of the engine; and a power storage mechanism for storing power by pulling the recoil rope and rotating the recoil pulley, the power storage mechanism being provided between the recoil pulley and the wheel member, wherein the crankshaft has an end passing through the pulley support shaft and inserted into a one-way clutch which is attached to inside of the wheel member.

When the engine starts, rotation of the crankshaft is not transmitted to the wheel member by the one-way clutch. Consequently, there is no need for a structure in which a centrifugal ratchet and cam claws engage with each other, as in the conventional technique; there is no need for a structure such as that of the conventional technique in which a cylindrical rotating member is attached to the end of the crankshaft, and a reel support shaft such as in the conventional technique is provided on the extension axis of the crankshaft; and the dimensions of the power-storage-type recoil starter in the axial direction of the crankshaft can be reduced. Consequently, the size of the engine started by the power-storage-type recoil starter can be reduced.

Preferably, the power storage mechanism comprises a coil spring in which a number of turns between the recoil pulley and the wheel member gradually increases and power is stored by pulling of the recoil rope.

Desirably, the wheel member comprises a boss body through which the shaft end of the crankshaft passes, and the boss body has a front spring chamber for accommodating the power storage mechanism, the power storage mechanism being formed between the recoil pulley and a rear boss provided to a rear part of the boss body.

In a preferred form, the one-way clutch meshes with the crankshaft when power is transmitted from the power storage mechanism to the crankshaft, and the wheel member and the crankshaft thereby rotate integrally with each other via the one-way clutch.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
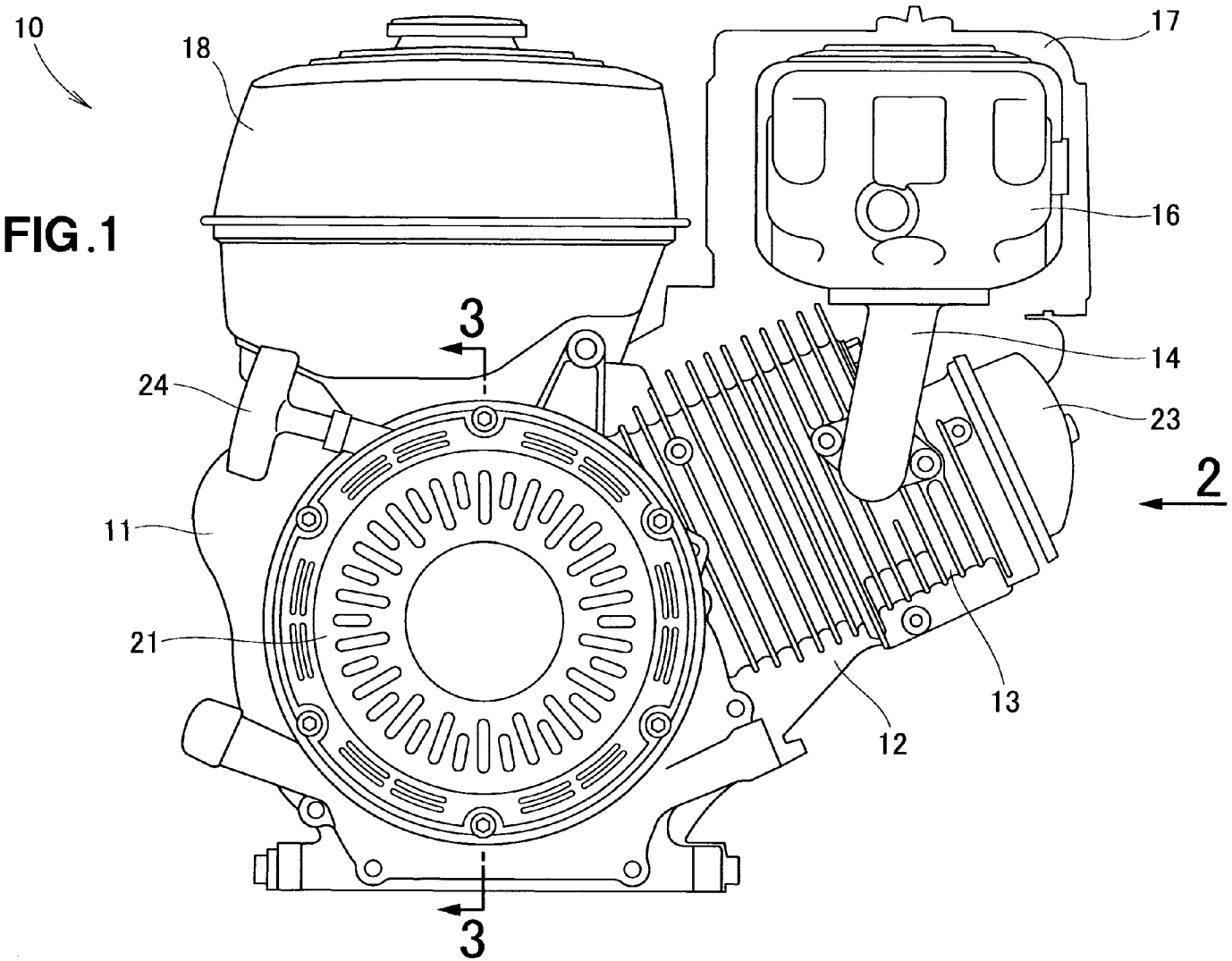
FIG. 1 is a front elevational view showing an engine provided with a power-storage-type recoil starter according to the present invention.
Figure 2:
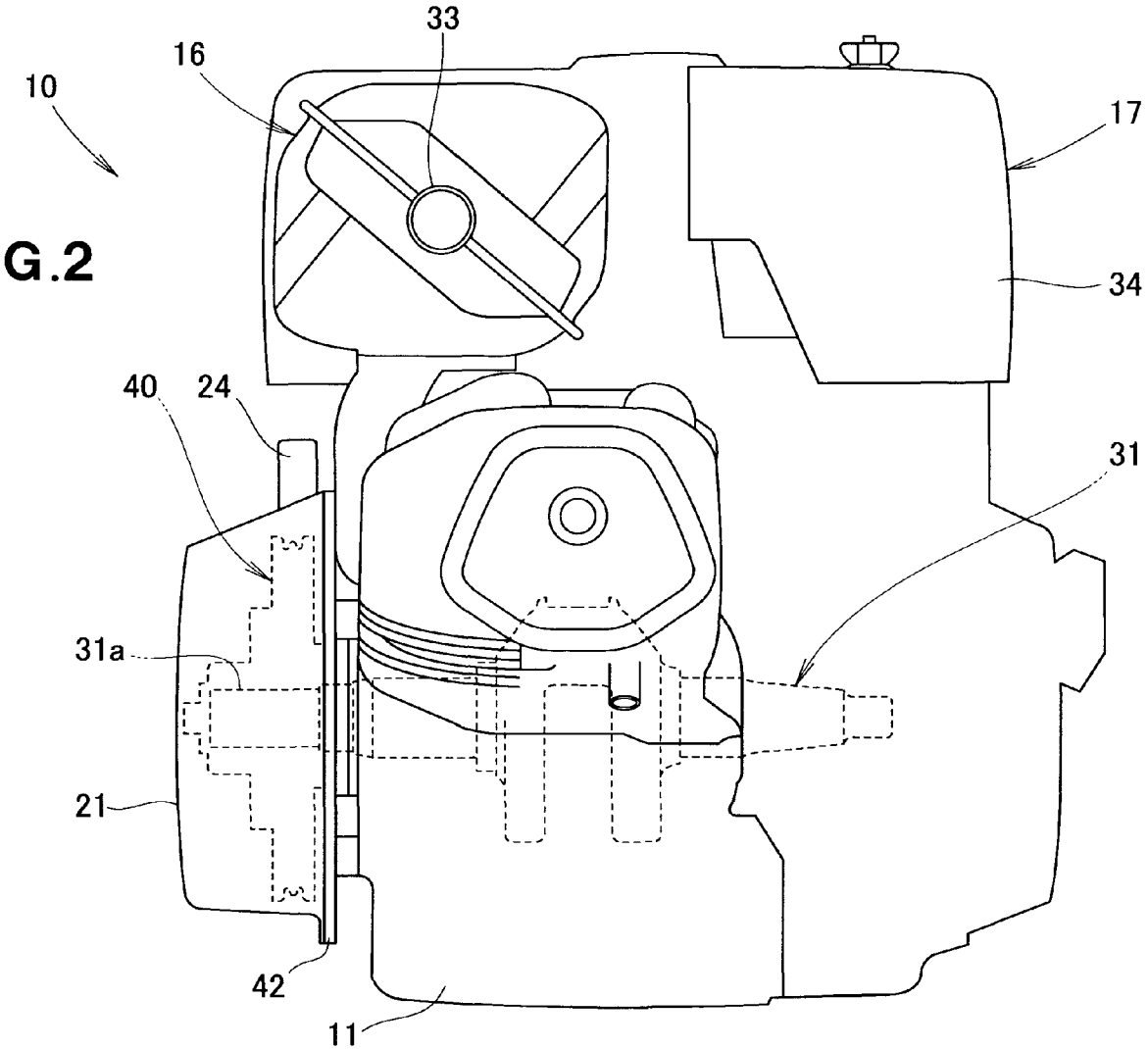
FIG. 2 is a view of the engine as seen in the direction of arrow 2 of FIG. 1.

An engine 10 shown in FIG. 1 is provided with a crankcase 11; a cylinder block 12 attached to the crankcase 11 so as to extend at an angle upward and to the side; a cylinder head 13 attached to an end of the cylinder block 12; a muffler 16 attached to the front of the cylinder head 13 via an exhaust pipe 14; a carburetor (not shown) attached to the rear of the cylinder head 13; an air cleaner 17 connected to the carburetor; a fuel tank 18 attached to the top of the crankcase 11 to feed fuel to the carburetor; and a starter cover 21 attached to the front of the crankcase 11 in order to cover a power-storage-type recoil starter 40 (FIG. 2).

The reference numeral 23 refers to a head cover for covering an end opening of the cylinder head 13, and the reference numeral 24 refers to a starter handle (grip) that is provided to the power-storage-type recoil starter 40.

As shown in FIG. 2, a crankshaft 31 that extends to the front and rear is rotatably attached to the crankcase 11 of the engine 10. The power-storage-type recoil starter 40 covered by the starter cover 21 is provided to a front end of the crankshaft 31.

The reference numeral 33 refers to an exhaust port of the muffler 16. The air cleaner 17 has an air cleaner cover 34.

Figure 3:
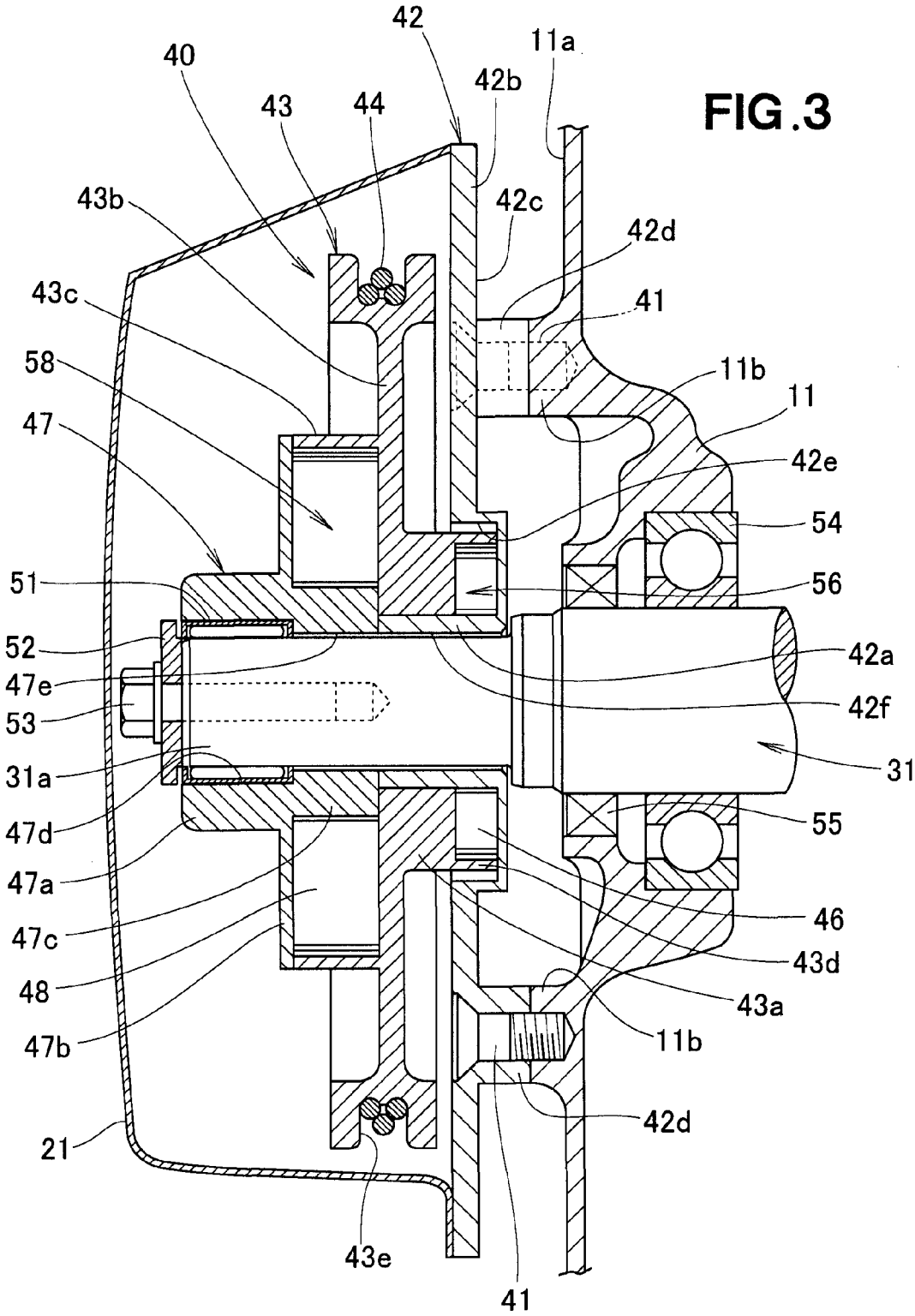
FIG. 3 is a sectional view taken along line 3-3 of FIG. 1.

As shown in FIG. 3, the power-storage-type recoil starter 40 is composed of a fixed plate 42 attached to a front surface 11*a* of the crankcase 11 by a plurality of screws 41; a recoil pulley 43 rotatably attached to a cylindrical shaft part (pulley support shaft) 42*a* provided in the center of the fixed plate 42; a recoil rope 44 wrapped onto the recoil pulley 43; a starter handle 24 (FIG. 1) attached to an end of the recoil rope 44; a returning spring 46 provided between the fixed plate 42 and the recoil pulley 43; an assist boss (wheel member) 47 provided adjacent to and in front of the recoil pulley 43; an assist spring (power storage mechanism) 48 provided between the recoil pulley 43 and the assist boss 47; a one-way clutch 51 pressed into the inside of the assist boss 47 and fitted on a shaft end 31*a* of the crankshaft 31 so as to be able to rotate in one direction; a washer 52 for preventing the one-way clutch 51 from coming off the shaft end 31*a*; and a bolt 53 for attaching the washer 52 to the shaft end 31*a*.

The reference numeral 54 refers to a bearing for rotatably supporting the crankshaft 31, and the reference numeral 55 refers to a seal member.

The one-way clutch 51 is provided between the assist boss 47 and the shaft end 31*a* of the crankshaft 31; i.e., the shaft end 31*a* of the crankshaft 31 is configured to pass through the one-way clutch 51.

The fixed plate 42 is composed of a plate-shaped part 42*b*, a plurality of attachment bosses 42*d* formed on a back surface 42*c* of the plate-shaped part 42*b* so as to protrude to the rear, an annular concave part 42*e* formed in the center of the plate-shaped part 42*b*, and a cylindrical shaft part 42*a* formed on an internal wall of the annular concave part 42*e*.

The starter cover 21 is attached to the external periphery of the fixed plate 42.

The attachment bosses 42*d* are attached by the screws 41 to crankcase bosses 11*b* formed on the front surface 11*a* of the crankcase 11.

A pulley boss 43*a* formed integrally with the rear part of the recoil pulley 43 is inserted into the annular concave part 42*e*. The cylindrical shaft part 42*a* rotatably supports the pulley boss 43*a* of the recoil pulley 43. A gap is formed between an external peripheral surface 42*f* of the cylindrical shaft part 42*a* and the shaft end 31*a* of the crankshaft 31.

The recoil pulley 43 is composed of a pulley main body 43*b*, the pulley boss 43*a* formed at the rear of the pulley main body 43*b*, and a front cylinder part 43*c* formed at the front of the pulley main body 43*b*.

A rear spring chamber 56 for accommodating the returning spring 46 is formed between the cylindrical shaft part 42*a* of the fixed plate 42 and a rear cylinder part 43*d* formed at an end of the pulley boss 43*a*. One end each of the returning spring 46 is attached to the rear cylinder part 43*d* and the cylindrical shaft part 42*a*. A rope groove 43*e* is formed along the entire external periphery of the pulley main body 43*b*. The recoil rope 44 is wrapped into the rope groove 43*e*.

When the recoil rope 44 is pulled and the recoil pulley 43 is rotated about the cylindrical shaft part 42*a* of the fixed plate 42, the number of turns of the returning spring 46 gradually increases, and power is stored therein. When pulling of the recoil rope 44 is stopped and the recoil rope 44 is relaxed, the recoil pulley 43 is rotated in reverse by the stored power, and the recoil pulley 43 returns to the original position.

The assist boss 47 is composed of a boss body 47*a* through which the shaft end 31*a* of the crankshaft 31 passes, and a flange part 47*b* that extends in the radial direction from an external peripheral surface of the boss body 47*a*.

A rear boss 47*c* is provided at the rear of the boss body 47*a*, a front spring chamber 58 for accommodating the assist spring 48 is formed between the rear boss 47*c* and the front cylinder part 43*c* of the recoil pulley 43, and one end each of the assist spring 48 is attached to the rear boss 47*c* and the front cylinder part 43*c*.

A large-diameter hole 47*d* into which the one-way clutch 51 is pressed is formed on the internal peripheral surface of the boss body 47*a*. A gap is formed between an internal peripheral surface 47*e* of the rear boss 47*c* and the shaft end 31*a* of the crankshaft 31.

The assist spring 48 is a coil spring in which the number of turns between the recoil pulley 43 and the assist boss 47 gradually increases and power is stored when the recoil rope 44 is pulled and the recoil pulley 43 is rotated about the cylindrical shaft part 42*a* of the fixed plate 42. When pulling of the recoil rope 44 is stopped, and the state of pulling is maintained after power is stored in the assist spring 48, the stored power is transmitted to the crankshaft 31 via the assist boss 47 and the one-way clutch 51, the crankshaft 31 is rotated, and the engine starts.

When power is transmitted to the crankshaft 31 from the assist spring 48, the one-way clutch 51 is in a meshed state, and the assist boss 47 and the crankshaft 31 rotate in integral fashion via the one-way clutch 51.

Figure 4A:
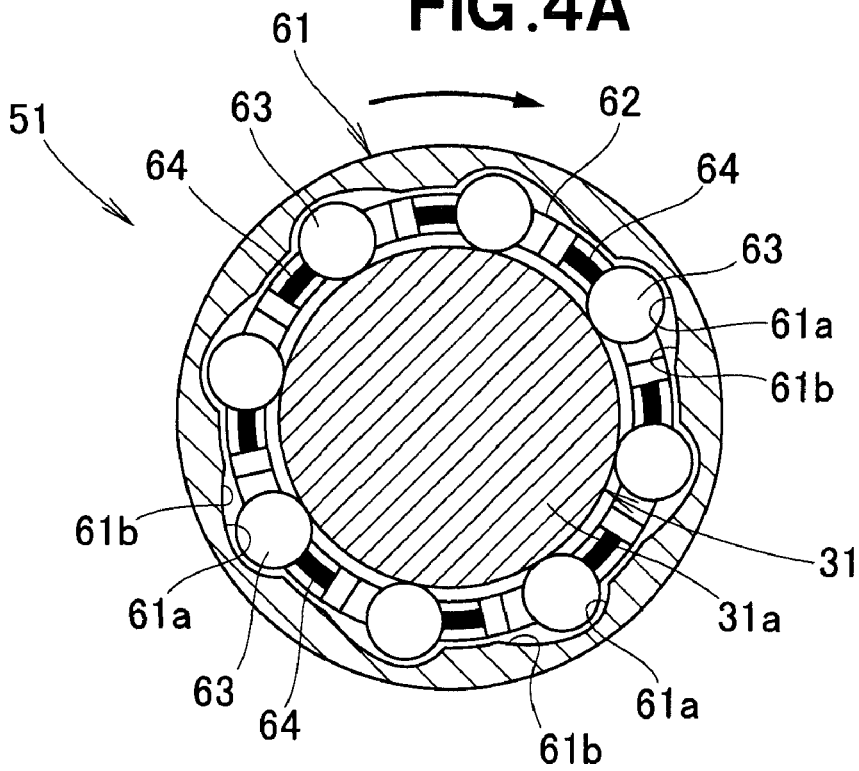
FIGS. 4A and 4B are sectional views showing the structure and operation of a one-way clutch.
Figure 4B:
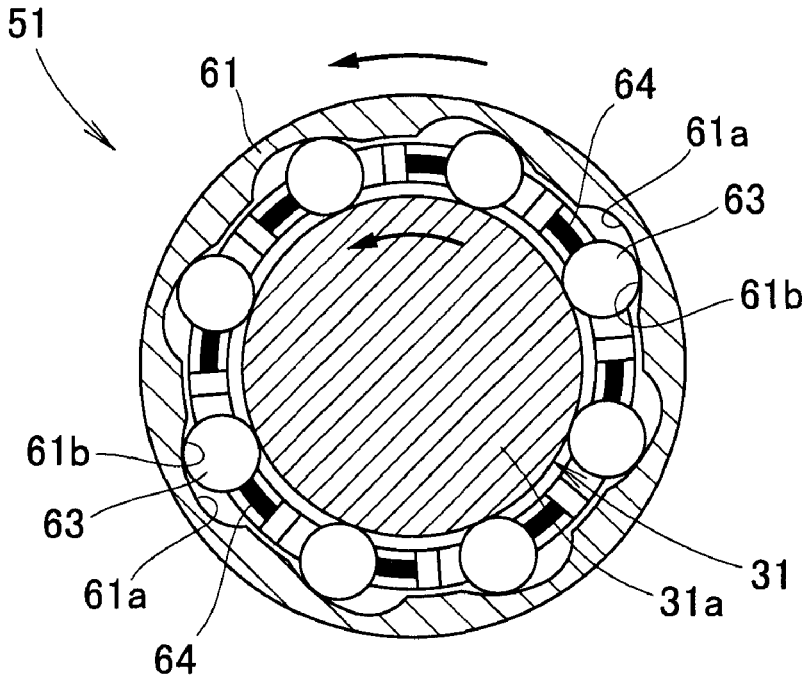

FIGS. 4A and 4B show the structure and operation of the one-way clutch.

A shown in FIG. 4A, the one-way clutch 51 is composed of an outer wheel 61, a retainer 62 rotatably attached to the inside of the outer wheel 61, and a plurality of rollers 63 retained by the retainer 62.

Depressions 61*a* are formed in the internal peripheral surface of the outer wheel 61 so as to correspond to the rollers 63, and cam surfaces 61*b* formed so as to gradually approach the shaft end 31*a* of the crankshaft 31 are formed in the depressions 61*a*.

The retainer 62 is provided with elastic members 64 for retaining the rollers 63 in the circumferential direction of the one-way clutch 51.

In the drawings, the rollers 63 are kept in a free state in the depressions 61*a* of the outer wheel 61. The outer wheel 61 rotates in the direction of the arrow with respect to the shaft end 31*a* of the crankshaft 31.

In FIG. 4B, when the outer wheel 61 is rotated in the direction of the arrow with respect to the shaft end 31*a* of the crankshaft 31, the rollers 63 move into the wedge-shaped spaces formed by the shaft end 31*a* and the cam surfaces 61*b* of the outer wheel 61, and the one-way clutch 51 is brought to a meshed state. The shaft end 31*a* therefore rotates together with the outer wheel 61 via the plurality of rollers 63, and the outer wheel 61 and the shaft end 31*a* do not rotate relative to each other.

An operation of the power-storage-type recoil starter 40 described above will next be described.

Figure 5A:
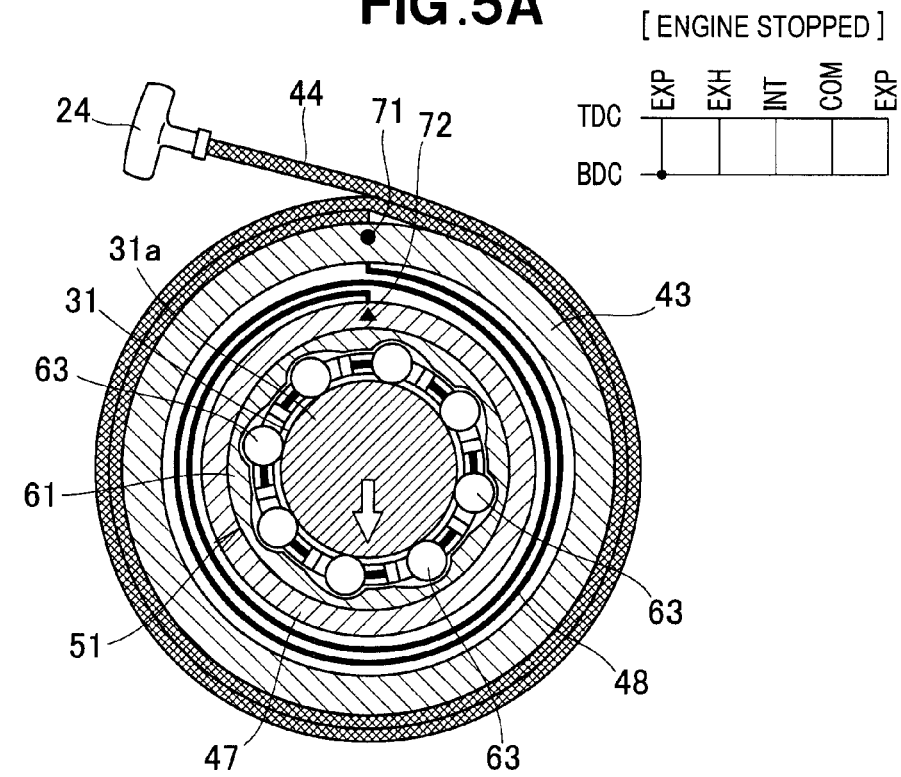
FIGS. 5A and 5B are sectional views showing the power-storage-type recoil starter in a state in which the engine has not been started.
Figure 5B:
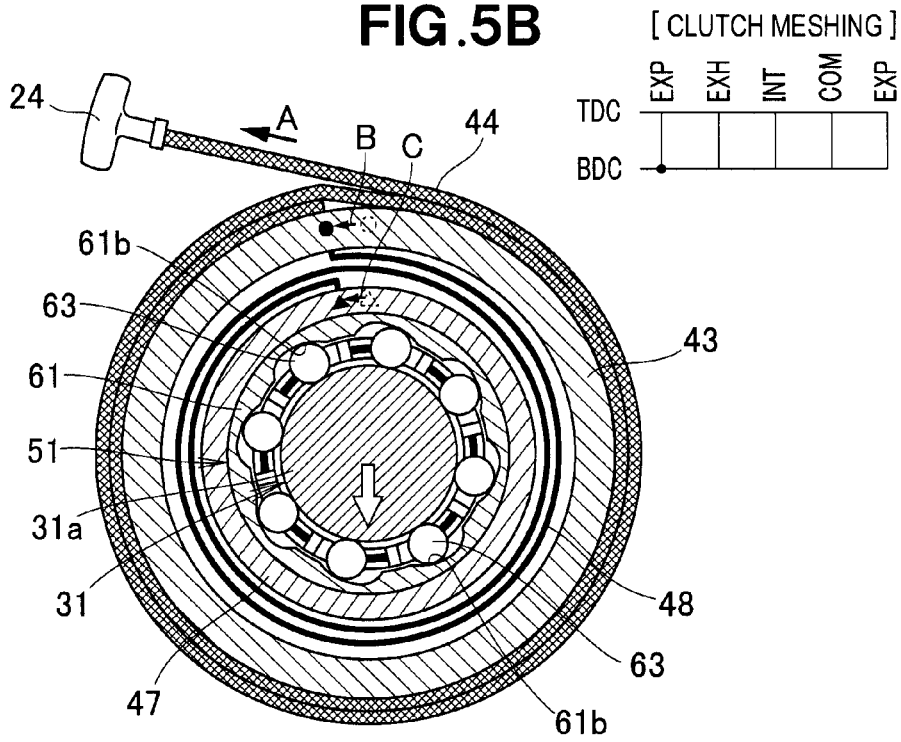

FIGS. 5A and 5B show the operation of the recoil starter when the recoil rope is not pulled, and when the recoil rope is slightly pulled when the engine is stopped.

FIG. 5A shows a state when the engine is stopped.

The starter handle 24 is attached to one end of the recoil rope 44, and the other end of the recoil rope 44 is attached to an external peripheral part of the recoil pulley 43.

One end of the assist spring 48 is attached to an internal peripheral part of the recoil pulley 43, and the other end of the assist spring 48 is attached to an external peripheral part of the assist boss 47. The outer wheel 61 of the one-way clutch 51 is pressed in on the internal peripheral surface of the assist boss 47, and the plurality of rollers 63 of the one-way clutch 51 is arranged so as to be able to touch the external peripheral surface of the shaft end 31*a* of the crankshaft 31.

In the structure described above, the rotational force transmitted to the recoil pulley 43 via the recoil rope 44 by the pulling of the starter handle 24 acts on the assist spring 48 so as to increase the number of turns thereof and store power, and the rotational force is furthermore transmitted to the assist boss 47. The assist boss 47 is thereby rotated, causing the one-way clutch 51 to rotate so as to mesh with the crankshaft 31 and to cause the crankshaft 31 to rotate.

A piston connected to the crankshaft 31 of the engine via a connecting rod is positioned at the bottom dead center (BDC) of the engine expansion (EXP) stroke, for example, as indicated by a black circle in the piston position display chart shown in the drawing, and the crankshaft is stopped in a rotation position that corresponds to this piston position. The white arrow in the drawing indicates the rotation position of the crankshaft 31 (the white arrow points downward, indicating that the piston is positioned at the bottom dead center). In the piston position display chart, reference character EXP indicates an expansion stroke; EXH an exhaust stroke; INT an intake stroke; and COM a compression stroke, The black circle 71 on the recoil pulley 43, and the black triangle 72 on the assist boss 47 in the drawing indicate the target rotation positions of the recoil pulley 43 and the assist boss 47, respectively.

Beginning in the state shown in FIG. 5A, when the recoil rope 44 is pulled as indicated by the arrow A by the starter handle 24 as shown in FIG. 5B, the recoil pulley 43, the assist spring 48, the assist boss 47, and the outer wheel 61 of the one-way clutch 51 rotate substantially integrally as indicated by the arrows B and C. As a result, the plurality of rollers 63 of the one-way clutch 51 is placed between the shaft end 31*a* of the crankshaft 31 and the cam surfaces 61*b* of the outer wheel 61, the outer wheel 61 of the one-way clutch 51 is meshed with the shaft end 31*a*, and the outer wheel 61 and shaft end 31*a* are able to rotate integrally with each other.

Figure 6A:
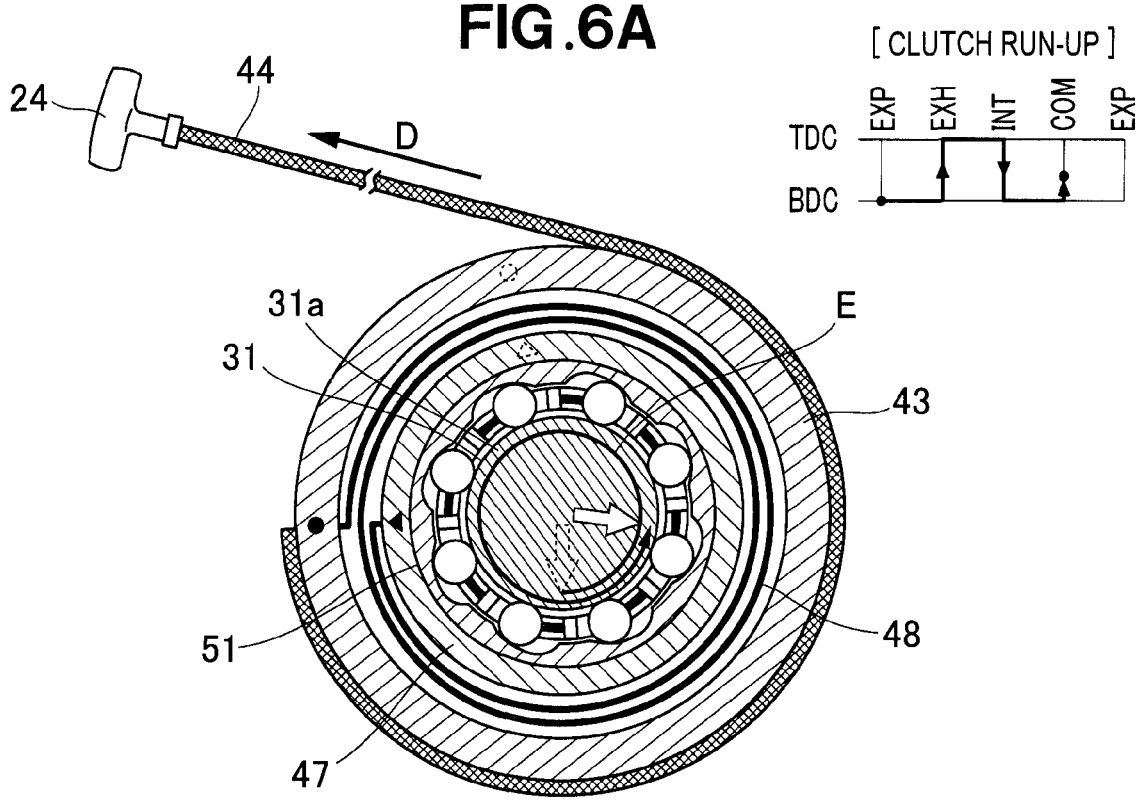
FIGS. 6A and 6B are sectional views showing an operation of the power-storage-type recoil starter in a state in which a recoil rope has been pulled and power is stored.
Figure 6B:
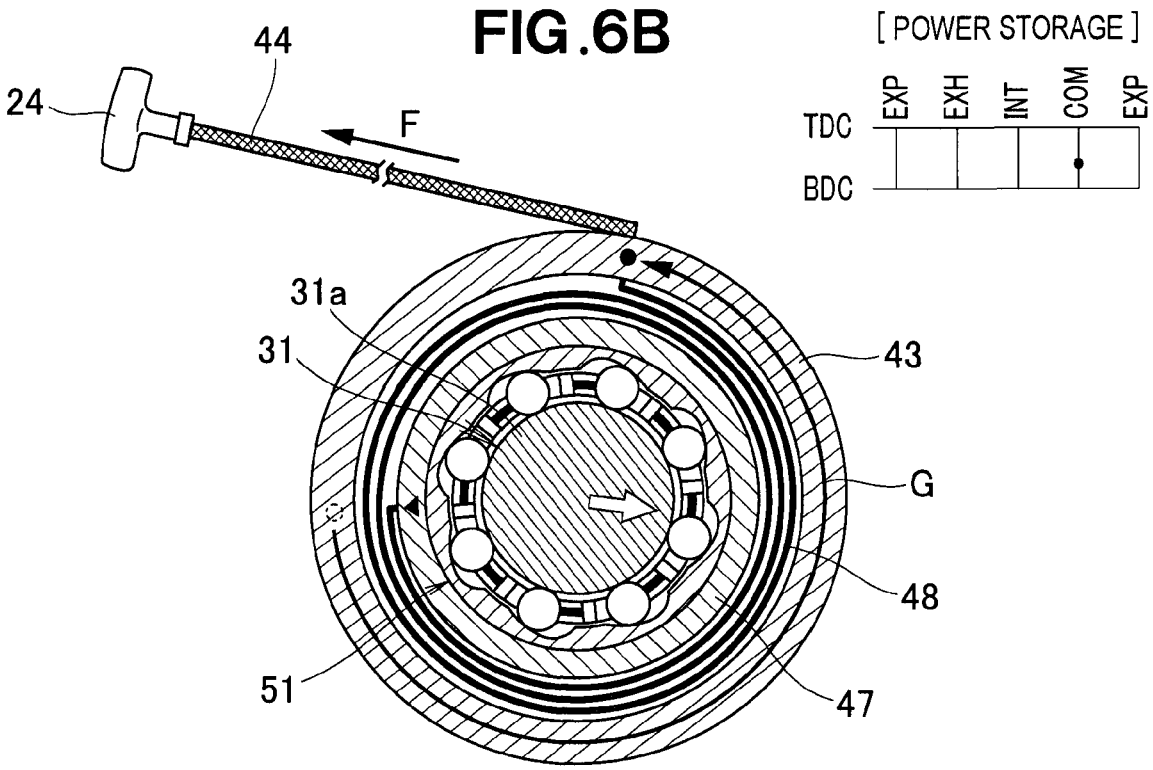

FIGS. 6A and 6B show a state in which the recoil rope is further pulled from the state shown in FIG. 5B.

Beginning in the state shown in FIG. 5B, the recoil rope 44 is further pulled in the direction of the arrow D as shown in FIG. 6A, and the crankshaft 31 is rotated as indicated by the arrow E until the piston reaches the initial position of the compression stroke.

Rotation range of the crankshaft 31 at this time is the run-up zone of the rotation of the crankshaft 31. The recoil pulley 43, the assist spring 48, the assist boss 47, the one-way clutch 51, and the crankshaft 31 rotate substantially integrally, and there is almost no twisting of the assist spring 48.

In this rotation position of the crankshaft 31, since the compression pressure inside the combustion chamber increases, a response is suddenly felt when the recoil rope 44 is pulled by the starter handle 24, and a large pulling force is required.

Beginning in the state shown in FIG. 6A, when the recoil rope 44 is further pulled by the starter handle 24 as indicated by the arrow F in FIG. 6B, since the rotation of the crankshaft 31 is almost completely stopped by the abovementioned high pressure in the combustion chamber, there is also almost no rotation of the one-way clutch 51 and the assist boss 47, and the assist spring 48 is therefore twisted by the rotation of the recoil pulley 43 such as indicated by the arrow G so that the number of turns of the assist spring 48 increases, and power is stored in the assist spring 48.

Figure 7A:
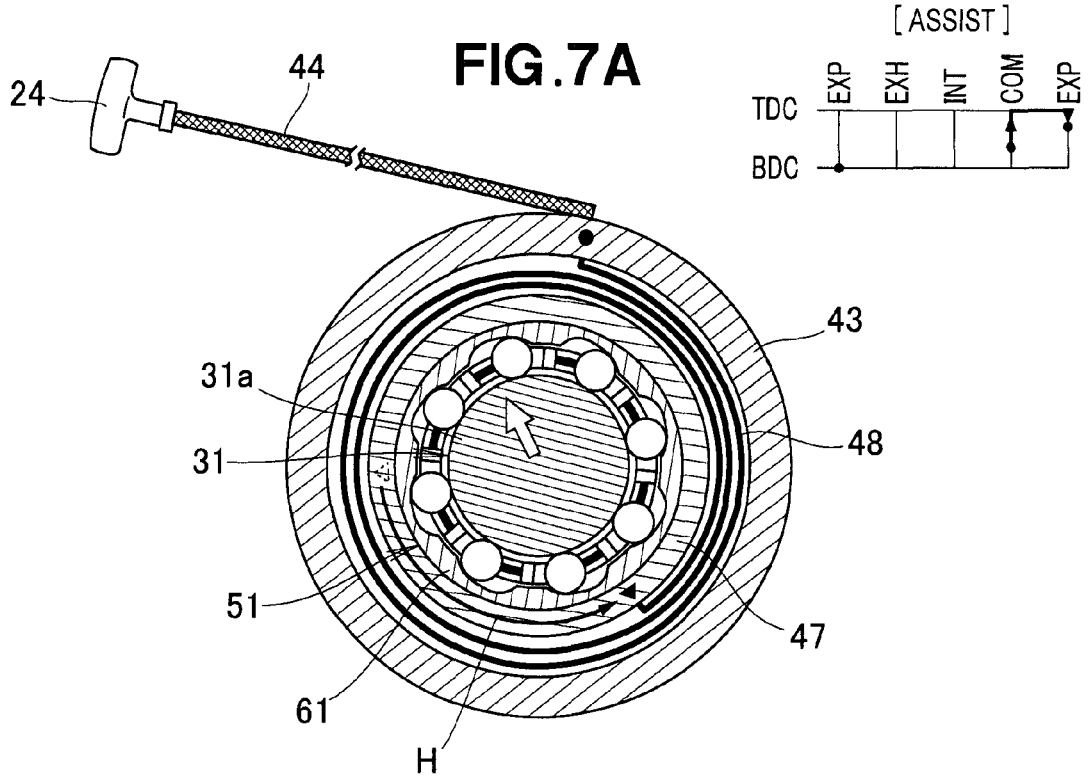
FIGS. 7A and 7B are sectional views showing an operation of the power-storage-type recoil starter, with a crankshaft rotating from the power-stored state shown in FIG. 6B.
Figure 7B:
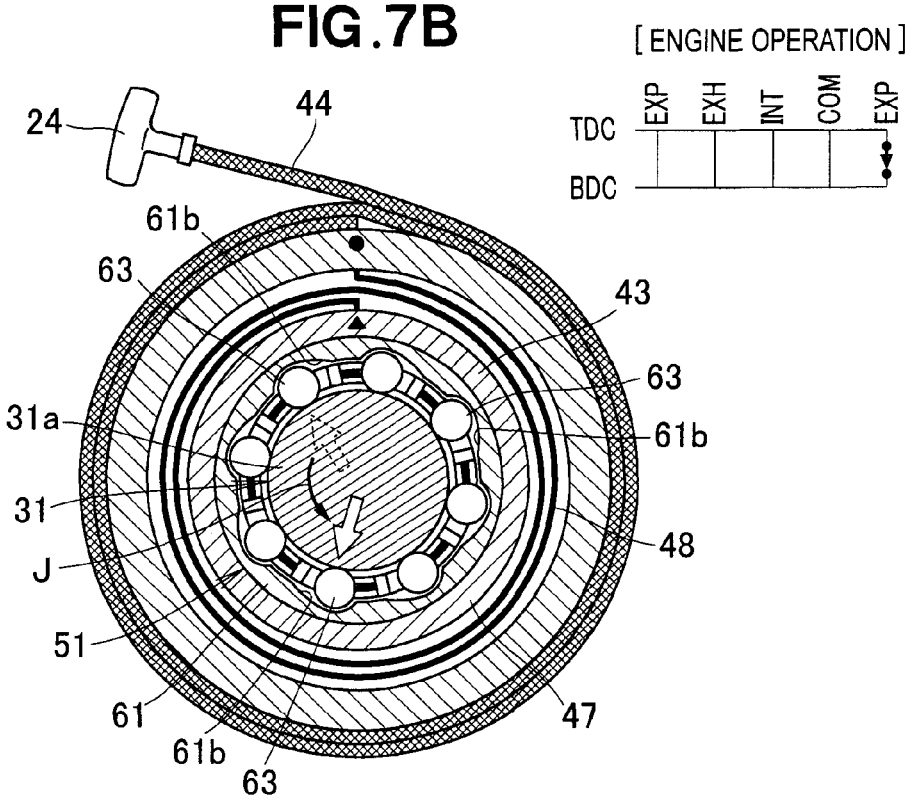

FIGS. 7A and 7B show the state in which the crankshaft 31 is rotated by the rotational force stored by the assist spring 48.

When the rotational force stored by the assist spring 48 in the state shown in FIG. 6B reaches a predetermined rotational force, the assist boss 47, the one-way clutch 51, and the shaft end 31*a* of the crankshaft 31 are assisted by the rotational force so as to rotate integrally as indicated by the arrow H in FIG. 7A, and the piston moves past the top dead center of the compression stroke to the expansion stroke. Combustion of the mixture begins at this time in the combustion chamber of the engine, and the engine starts.

When the crankshaft 31 in the state shown in FIG. 7A begins to rotate as indicated by the arrow J under its own power as shown in FIG. 7B, the rollers 63 separate from the cam surfaces 61*b* of the outer wheel 61 of the one-way clutch 51; a state occurs in which the outer wheel 61, the assist boss 47, the assist spring 48, and the recoil pulley 43 are separated from the shaft end 31*a* of the crankshaft 31; and rotation stops. When pulling of the recoil rope 44 is also relaxed, the outer wheel 61, the assist boss 47, the assist spring 48, and the recoil pulley 43 are also returned to the original positions thereof (positions shown in FIG. 5A) by the returning spring 46 (see FIG. 3).

Figure 8:
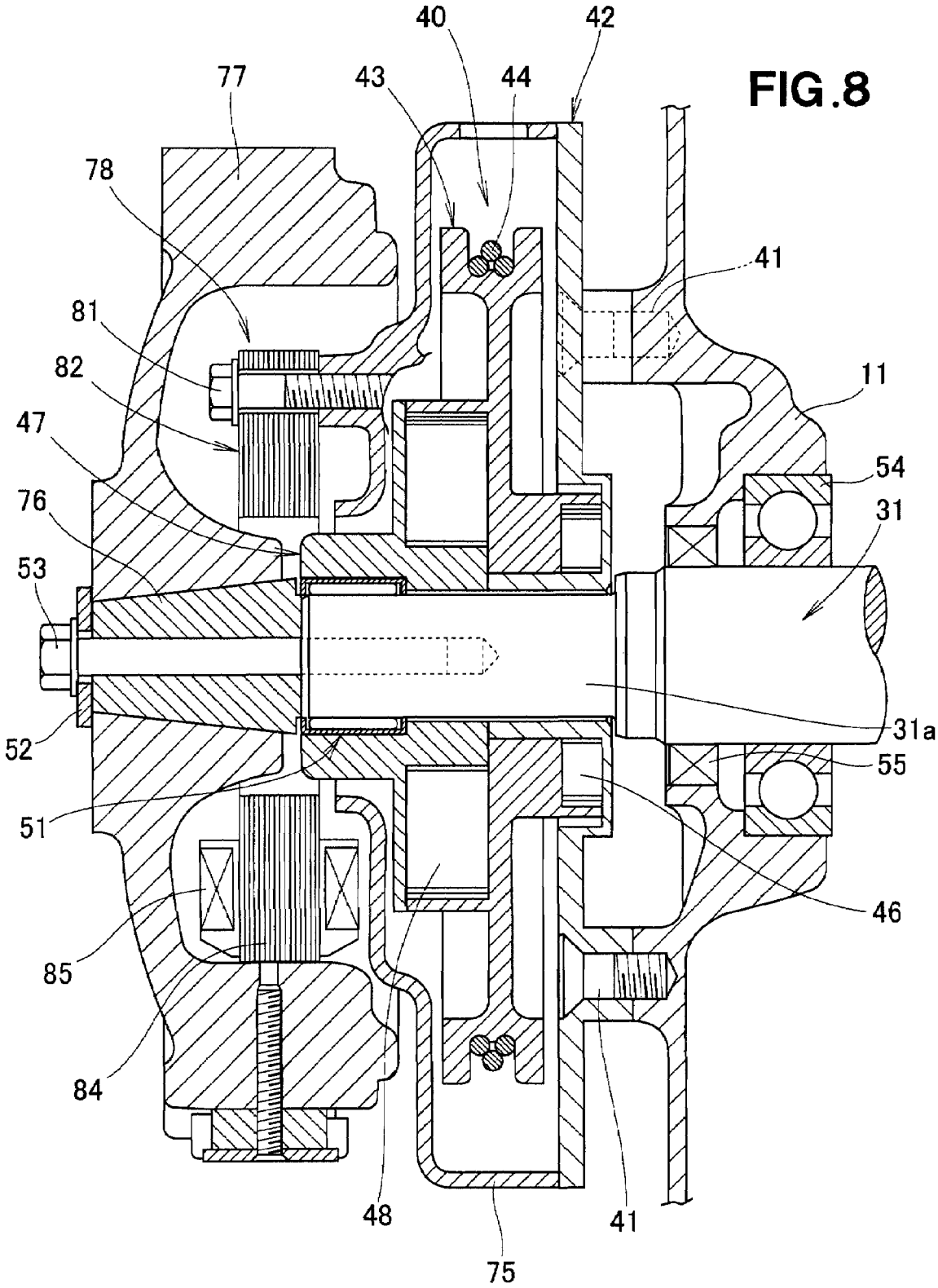
FIG. 8 is a sectional view showing an example of the recoil starter of the present invention being used in an engine generator.

FIG. 8 shows an example in which the power-storage-type recoil starter 40 of the present embodiment is applied to an engine generator.

As shown in FIG. 8, a cover member 75 is attached to the fixed plate 42 so as to cover the power-storage-type recoil starter 40, a flywheel 77 is attached to the distal end of the shaft end 31*a* of the crankshaft 31 via an extended tapered shaft 76, and a generator 78 is attached to the cover member 75 and flywheel 77.

The generator 78 is composed of a stator 82 attached to the cover member 75 by a plurality of bolts 81; and a rotor (not shown) attached to the flywheel 77 so as to rotate near the periphery of the stator 82.

The stator 82 is composed of a stator core 84 and a stator coil 85 that is wrapped onto the stator core 84.

As shown in FIGS. 3, 5A, and 5B above, the power-storage-type recoil starter 40 is provided with the recoil pulley 43 rotatably supported by the cylindrical shaft part 42*a* as a pulley support shaft, the recoil rope 44 being wrapped onto the recoil pulley 43; the assist boss 47 as a wheel member rotatably supported on the crankshaft 31 of the engine 10 (FIG. 1); and the assist spring 48 as a power storage mechanism that is provided between the recoil pulley 43 and the assist boss 47. In the power-storage-type recoil starter 40, the recoil rope 44 is pulled to rotate the recoil pulley 43, whereby power is stored in the assist spring 48, and the power is transmitted from the assist spring 48 to the crankshaft 31 via the assist boss 47, thereby starting the engine 10. The shaft end 31*a* of the crankshaft 31 is configured to pass through the cylindrical shaft part 42*a*, and the shaft end 31*a* of the crankshaft 31 is inserted into the one-way clutch 51 that is attached to the inside of the assist boss 47. The assist boss 47, the one-way clutch 51, and the crankshaft 31 can therefore be arranged in the radial direction, and the dimensions of the power-storage-type recoil starter 40 can be reduced in the axial direction of the crankshaft. Consequently, the engine 10 that includes the power-storage-type recoil starter 40 can be reduced in size.

The one-way clutch 51 was positioned further forward than the assist spring 48 in the present embodiment, as shown in FIG. 3, but this configuration is not limiting, and the one-way clutch 51 may also be provided on the inside in the radial direction of the assist spring 48. The dimensions of the crankshaft 31 in the front and rear, i.e., the length of the crankshaft 31, can thereby be reduced, and the engine 10 that includes the power-storage-type recoil starter 40 (FIG. 1) can be reduced in size.

Obviously, various minor changes and modifications of the present invention are possible in light of the above teaching. It is therefore to be understood that within the scope of the appended claims the invention may be practiced otherwise than as specifically described.

What is claimed is:

1. A power-storage-type engine starting system comprising:

a power-storage-type recoil starter;

a crankshaft rotatable by the recoil starter to start the engine;

a recoil pulley rotatably supported by a pulley support shaft and having a recoil rope wrapped therearound;

a wheel member adapted to be rotatably supported by the crankshaft of the engine; and a power storage mechanism for storing power by pulling the recoil rope and rotating the recoil pulley, the power storage mechanism being provided between the recoil pulley and the wheel member, wherein the crankshaft has an end passing through the pulley support shaft and inserted into a one-way clutch which is attached to inside of the wheel member.

2. The engine starting system of claim 1, wherein the power storage mechanism comprises a coil spring in which a number of turns between the recoil pulley and the wheel member gradually increases and power is stored by pulling of the recoil rope.

3. The engine starting system of claim 1, wherein the wheel member comprises a boss body through which the shaft end of the crankshaft passes, and the boss body has a front spring chamber for accommodating the power storage mechanism, the power storage mechanism being formed between the recoil pulley and a rear boss provided to a rear part of the boss body.

4. The engine starting system of claim 1, wherein the one-way clutch meshes with the crankshaft when power is transmitted from the power storage mechanism to the crankshaft, and the wheel member and the crankshaft thereby rotate integrally with each other via the one-way clutch.

* * * * *

UNITED STATES PATENT AND TRADEMARK OFFICE

CERTIFICATE OF CORRECTION

PATENT NO. : 7,810,465 B2
APPLICATION NO. : 12/478207
DATED : October 12, 2010
INVENTOR(S) : Yoshikazu Sato et al.

It is certified that error appears in the above-identified patent and that said Letters Patent is hereby corrected as shown below:

On the cover page, Item (75);
Change second inventors name

"Hiroshi Moriyana, Wako (JP)"

To be

--Hiroshi Moriyama, Wako (JP)--

Signed and Sealed this
Eleventh Day of January, 2011

David J. Kappos

David J. Kappos
*Director of the United States Patent and Trademark Office*